US006615507B2

(12) United States Patent
Ruscheweyh et al.

(10) Patent No.: US 6,615,507 B2
(45) Date of Patent: Sep. 9, 2003

(54) MIXER FOR MIXING GASES AND OTHER NEWTON LIQUIDS

(75) Inventors: Hans Ruscheweyh, Aachen (DE); Michael Kaatz, Ratingen (DE)

(73) Assignee: Balcke-Durr Energietechnik GmbH (DE)

( * ) Notice: Subject to any disclaimer, the term of this patent is extended or adjusted under 35 U.S.C. 154(b) by 0 days.

(21) Appl. No.: 09/884,682

(22) Filed: Jun. 19, 2001

(65) Prior Publication Data

US 2002/0020076 A1 Feb. 21, 2002

(30) Foreign Application Priority Data

Jun. 19, 2000 (EP) ..... 00112874

(51) Int. Cl.[7] ..... F26B 11/12

(52) U.S. Cl. ..... 34/181; 34/84; 34/231; 366/337; 366/341; 137/808; 137/809

(58) Field of Search ..... 34/68, 84, 181, 34/226, 231; 366/336, 337, 341; 137/809, 808

(56) References Cited

U.S. PATENT DOCUMENTS 3,671,208 A * 6/1972 Medsker ..... 48/180.1
3,871,624 A * 3/1975 Huber et al. ..... 366/336
3,918,688 A * 11/1975 Huber et al. ..... 366/336
5,518,311 A * 5/1996 Althaus et al. ..... 366/181.5

FOREIGN PATENT DOCUMENTS

DE 2509784 A * 11/1975
DE 2810648 A * 9/1979

* cited by examiner

*Primary Examiner*—Ira S. Lazarus
*Assistant Examiner*—Kathryn S. O'Malley
(74) *Attorney, Agent, or Firm*—Cantor Colburn LLP

(57) ABSTRACT

The invention provides a mixer for mixing gases and other Newton liquids, with a flow channel and built-in surfaces arranged in the flow channel that influence the flow. The built-in surfaces are vortex-generating surfaces with free surging leading edges directed against the flow whose path, the surging leading edges having both a component running in the main flow direction of the gas and a component running transverse to it. To make mixing fast and the mixing distance short, several built-in surfaces of the same type are arranged in a row basically transverse to the main flow direction. Built-in surfaces next to one another overlap in relation to the main flow direction.

10 Claims, 1 Drawing Sheet

MIXER FOR MIXING GASES AND OTHER NEWTON LIQUIDS

FIELD OF THE INVENTION

The invention concerns a mixer for mixing gases and other Newton liquids, with a flow channel arranged in it and built-in surfaces influencing the flow, whereby the built-in surfaces are vortex-generating with free, surging leading edges directed against the flow, and their path has one component running in the main direction of the stream of gas and one component running transverse to it.

DESCRIPTION OF THE RELATED ART

To mix streams of gases or liquids in pipelines or channels requires mixing lengths from 15 to 100 times the diameter of the channel if the flow is turbulent. This mixing length can be clearly shortened by using suitable static mixers designed as built-in bodies. However, in most conventionally used systems, there is a high loss of pressure when high demands are made on the homogeneity of the mix being adjusted. Many of the conventional mixing systems are also limited to simple geometries, for example, cylindrical pipes or square channels, and cannot be used in large facilities and systems with complicated mixing chambers.

A static mixer is known from DE 29 11 873 C2 in which the built-in parts consist of surfaces that are shaped like deltoids or circular disks flowing at an angle, on whose leading edges vortices are generated. The stationary, stable vortex systems made this way work far into the flow trailer, and the components being mixed are rolled in the layer form, which produces fast mixing with very low pressure losses. These so-called "built-in vortex surfaces" have been proven in practice due to the short mixing distances that can be achieved.

SUMMARY OF THE INVENTION

The problem of the invention is to create a mixer for mixing gases and other Newton liquids that mixes fast at even shorter mixing distances.

To solve this problem, the invention proposes a mixer with the features mentioned at the beginning in which several similar built-in surfaces are placed in a row basically transverse to the main flow direction and built-in surfaces next to one another partly overlap in relation to the main flow direction.

A mixer designed in this way makes it possible to mix the stream very fast with a very short mixing distance. The result of this mixing is the fact that the profiles of the gas and/or liquid flowing through it are homogenized, preventing losses of performance. Despite the generation of extended, stable vortices, the built-in vortex surface in the invention has a relatively low flow resistance, since it does not act as a conductive surface with its whole surface, but produces static vortex fields with its leading edges that extend automatically in the flow direction, with no need for additional built-ins or conductive surfaces for such expansion. This produces low-loss, effective mixing over short mixing distances, at least due to the built-in vortex surfaces partly overlapping in the flow direction.

One preferred version of the mixer is characterized by another row of built-in surfaces placed some distance behind the row, whereby the angle of incidence of the built-in surfaces of the other row are opposed to the angle of incidence of the built-in surfaces in the first row. In addition to the mixing effect, this mixer design allows homogenization of the speed profile over the cross section of the flow channel.

The angle of incidence of the built-in surfaces in relation to the main flow direction is preferably between 40° and 80°, preferably 60°.

Another mixer design proposes that the flow channel have a basically rectangular cross section with a width to thickness ratio $B/D \geqq 2$, whereby the row defined by the built-in surfaces extends in the direction of the width.

BRIEF DESCRIPTION OF THE DRAWINGS

An example of embodiment of the mixer in the invention is shown on the drawing.

DETAILED DESCRIPTION OF THE PREFERRED EMBODIMENT

Figure 1:
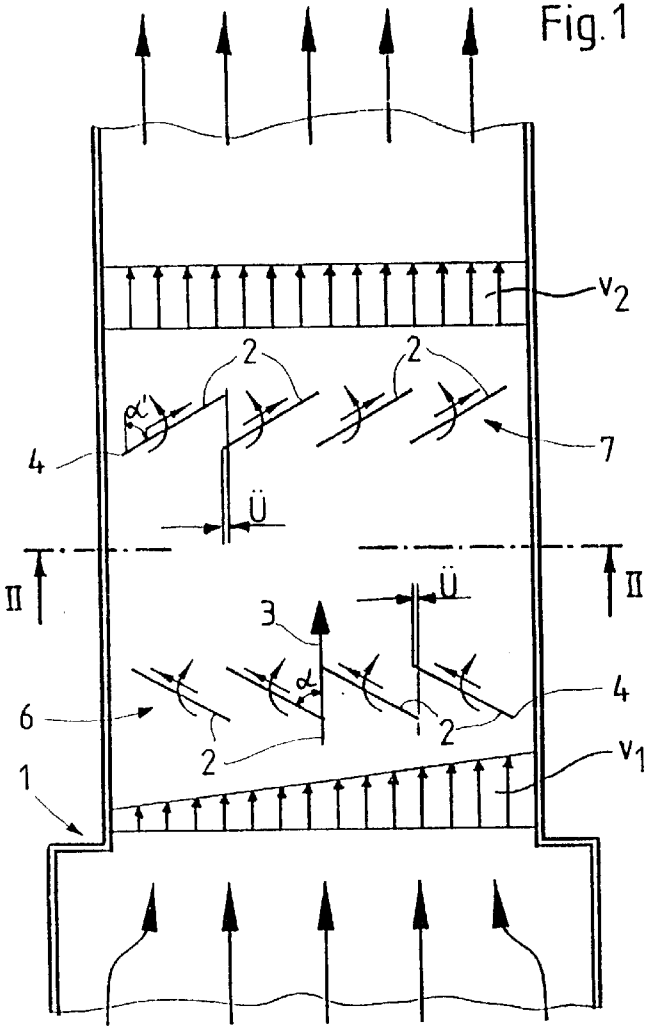

FIG. 1 shows a longitudinal section of a flow channel contracting at 1 with a rectangular cross section. The flow channel has a homogeneous gas or liquid mixture flowing through it. Gases and liquids are understood here as all so-called "Newton liquids," i.e. including liquids that behave like gases in their flow mechanical properties.

Figure 2:
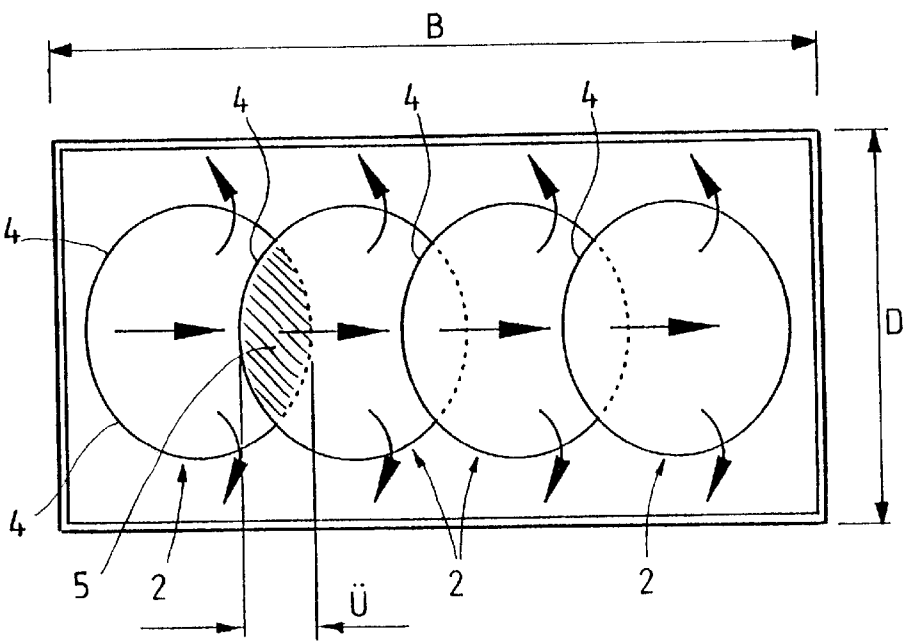
FIG. 1 shows a longitudinal section through a flow channel with built-in vortex surfaces arranged in two rows and FIG. 2 shows a cross section through the flow channel along plane II—II in FIG. 1.

FIG. 2 shows the flow channel, including its width B and its thickness D, in cross section. The width/thickness ratio should preferably be $B/D \geqq 2$.

Like FIG. 1, FIG. 2 shows that built-in surfaces 2 are arranged in rows in the flow channel. In the example of embodiment, the row is made up of a total of four built-in surfaces 2. The built-in surfaces 2 in each row, which basically extend transverse to the main direction of flow, are designed the same with preferably the same angle of incidence $\alpha$ to the main flow direction 3. The angle of incidence a to the main flow direction 3 is between 40° and 80°, preferably 60°.

The free surging leading edges 4 directed against the flow of the built-in surfaces 2, designed to be shaped like circular disks in the example of embodiment, both have a component in the main flow direction and a component running crosswise to it. Furthermore, since each built-in surface 2 is placed at a sharp angle to the main flow direction 3 in the flow channel, vortex fields are generated on each leading edge 4 of the built-in surfaces 2, and they spread out downstream in the shape of a circular cone. The individual vortices roll off to the inside on the back of built-in surface 2. The vortices generated on the individual leading edges 4 largely behave statically, and therefore do not change their position. Each vortex field forms, by its rotation, a flow component crosswise to the main flow direction of the gas, which results in good mixing of the gas mixture due to the associated pulse change crosswise to the flow direction. The mixing is further increased by the very compact arrangement of the built-in surfaces 2 in each row, in which adjacent built-in surfaces 2 partly overlap in relation to the main flow direction 3. This overlap is marked by reference number 5 in FIG. 2 and is crosshatched.

In FIG. 1, the speed profile of the gas flow at the entry to the mixing line is marked V. This speed profile is uneven because of the previous deflection of the gas flow. If a first row 6 of built-in surfaces 2 is followed by a second row 7 of built-in surfaces 2, and if the angle of incidence α of the built-in surfaces in the second row 7 is opposed to the angle of incidence α of the built-in surfaces in the first row 6, at the exit to the mixing line, the speed profile can be homogenized, as entered in FIG. 1 with speed profile V2.

In the example of embodiment, the built-in surfaces 2 are designed as round disks. In the same way, however, disks with delta-shaped or triangular basic shapes, or elliptical or parabola-shaped disks can be used as the built-in vortex surfaces. Such disks also have leading edges arranged symmetrically and at an angle to the middle plane, as they are decisive for generating the leading edge vortices.

What is claimed is:

1. A mixer for mixing gases and other Newton liquids, comprising:

a flow channel; and built-in surfaces in the flow channel which influence a flow therein;

said built-in surfaces having free surging leading edges directed against the flow for generating vortices within the flow, said free surging leading edges having one component running in a main flow direction of the gas and one component running transverse to the main flow direction;

wherein several built-in surfaces are arranged in a first row basically transverse to the main flow direction, and wherein built-in surfaces next to one another partly overlap in relation to the main flow direction.

2. The mixer of claim 1, further comprising a second row of built-in surfaces spaced from said first row, wherein an angle of incidence of the built-in surfaces in the second row is opposed to an angle of incidence of the built-in surfaces in the first row.

3. The mixer of claim 2, wherein an angle of incidence of the built-in surfaces is between 40° and 80°.

4. The mixer of claim 3, wherein the angle of incidence of the built-in surfaces is 60°.

5. The mixer of claim 2, wherein the flow channel has a rectangular cross section with a ratio of width (B) to thickness (D) of $B/D \geqq 2$, whereby the first row and the second row extend in a direction of the width.

6. The mixer of claim 1, wherein an angle of incidence of the built-in surfaces is between 40° and 80°.

7. The mixer of claim 6, wherein the angle of incidence of the built-in surfaces is 60°.

8. The mixer of claim 1, wherein the built-in surfaces are round, elliptical or triangular in shape.

9. The mixer of claim 1, wherein the flow channel has a rectangular cross section with a ratio of width (B) to thickness (D) of $B/D \geqq 2$, whereby the first row defined by the built-in surfaces extends in a direction of the width.

10. A mixer for mixing gases and other Newton liquids, comprising:

a flow channel; and built-in surfaces in the flow channel which influence a flow therein, comprising:

a plurality of built-in surfaces arranged in a first row transverse to the main flow direction, wherein individual built-in surfaces forming the plurality are aligned side-by-side, wherein each individual built-in surface has a front surface, and wherein at least one of the individual built-in surfaces further comprises:

a free surging leading edge overlapping the front surface of one of the adjacently disposed individual built-in surfaces, wherein the free surging leading edge is directed against the flow and has one component running in a main flow direction and one component running transverse to the main flow direction.

* * * * *